US011795781B2

(12) United States Patent
Parkin et al.

(10) Patent No.: US 11,795,781 B2
(45) Date of Patent: Oct. 24, 2023

(54) ACTUATION VALVE SYSTEM WITH PILOT AND MAIN VALVES

(71) Applicant: Schlumberger Technology Corporation, Sugar Land, TX (US)

(72) Inventors: Edward George Parkin, Stonehouse (GB); Michael Pearce, Stonehouse (GB); Julien Steimetz, Stonehouse (GB); Jonathan D. Marshall, Springville, UT (US); D. Peter Johnson, Provo, UT (US); Clint William Philbrick, Springville, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 247 days.

(21) Appl. No.: 17/198,475

(22) Filed: Mar. 11, 2021

(65) Prior Publication Data

US 2021/0198977 A1 Jul. 1, 2021

Related U.S. Application Data

(63) Continuation of application No. 16/108,142, filed on Aug. 22, 2018, now Pat. No. 10,947,814.

(51) Int. Cl.

| | |
|---|---|
| ***E21B 34/10*** | (2006.01) |
| ***E21B 7/06*** | (2006.01) |
| ***E21B 23/04*** | (2006.01) |

(52) U.S. Cl.
CPC ..... *E21B 34/10* (2013.01); *E21B 7/065* (2013.01); *E21B 23/04* (2013.01)

(58) Field of Classification Search
CPC ..... E21B 7/06; E21B 23/04; E21B 34/101; E21B 34/10
See application file for complete search history.

(56) References Cited

U.S. PATENT DOCUMENTS

| | | | |
|---|---|---|---|
| 4,257,456 | A | 3/1981 | Elliston |
| 5,113,953 | A | 5/1992 | Noble |
| 5,265,682 | A | 11/1993 | Russell et al. |
| 5,415,237 | A | 5/1995 | Strattan |
| 5,520,255 | A | 5/1996 | Barr et al. |
| 5,553,678 | A | 9/1996 | Barr et al. |
| 5,553,679 | A | 9/1996 | Thorp |
| 5,582,259 | A | 12/1996 | Barr |
| 5,603,385 | A | 2/1997 | Colebrook |
| 5,673,763 | A | 10/1997 | Thorp |
| 5,685,379 | A | 11/1997 | Barr et al. |

(Continued)

OTHER PUBLICATIONS

International Search Report and Written Opinion issued in International Patent application PCT/US2019/047439 dated Dec. 4, 2019, 12 pages.

*Primary Examiner* — Cathleen R Hutchins
(74) *Attorney, Agent, or Firm* — Jeffrey D. Frantz

(57) ABSTRACT

A tool, e.g. a downhole tool, utilizes at least one actuator which may be actuated rapidly between positions during operation of the tool. The actuator is moved via flow of an actuating fluid controlled by a main valve which, in turn, is controlled via a pilot valve. The pilot valve is operated to selectively control flow of the actuating fluid to the main valve so as to shift the main valve between desired operational positions.

20 Claims, 12 Drawing Sheets

(56) References Cited

U.S. PATENT DOCUMENTS

| | | | | |
|---|---|---|---|---|
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 2001/0052428 | A1 | 12/2001 | Larronde et al. | |
| 2002/0011359 | A1 | 1/2002 | Webb et al. | |
| 2009/0044979 | A1* | 2/2009 | Johnson | E21B 7/06 175/24 |
| 2010/0084031 | A1* | 4/2010 | Hunnicutt | F16K 99/0001 137/625.69 |
| 2011/0100645 | A1 | 5/2011 | Yapici | |
| 2013/0118758 | A1 | 5/2013 | Caminari | |
| 2018/0094490 | A1 | 4/2018 | Lines et al. | |
| 2020/0063526 | A1 | 2/2020 | Parkin et al. | |

* cited by examiner

ACTUATION VALVE SYSTEM WITH PILOT AND MAIN VALVES

CROSS-REFERENCE TO RELATED APPLICATIONS

This application is a continuation of U.S. patent application Ser. No. 16/108,142, filed Aug. 22, 2018 and titled "Pilot Controlled Actuation Valve System", which application is expressly incorporated herein by this reference in its entirety.

SUMMARY

In general, a system and methodology are provided to facilitate improved operation of tools which are rapidly actuated via hydraulic flow controlled by a valve or valves.

According to some embodiments, the tool, e.g. a downhole tool, utilizes at least one actuator which may be actuated rapidly between positions during operation of the tool. The actuator is moved via flow of an actuating fluid controlled by a main valve which, in turn, is shifted between operational positions via selective application of the actuating fluid under control of a corresponding pilot valve. For example, the pilot valve may be operated to control flow of a relatively small portion of the actuating fluid which can be used to actuate the corresponding main valve. The downhole tool may be a steering system, e.g., a rotary steerable system.

In some embodiments, a method includes providing a well tool having an actuator which may be actuated rapidly between positions during a downhole operation. The method includes controlling flow of an actuating fluid to the actuator via a main valve, the main valve being controlled via pressure differentials established by a flow of the actuating fluid. The main valve may be selectively actuated by a pilot valve which controls the flow of actuating fluid to the main valve. The quantity of the flow of actuating fluid which is controlled by the pilot valve is less than the flow of fluid through the main valve to the actuator.

However, many modifications are possible without materially departing from the teachings of this disclosure. Accordingly, such modifications are intended to be included within the scope of this disclosure.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
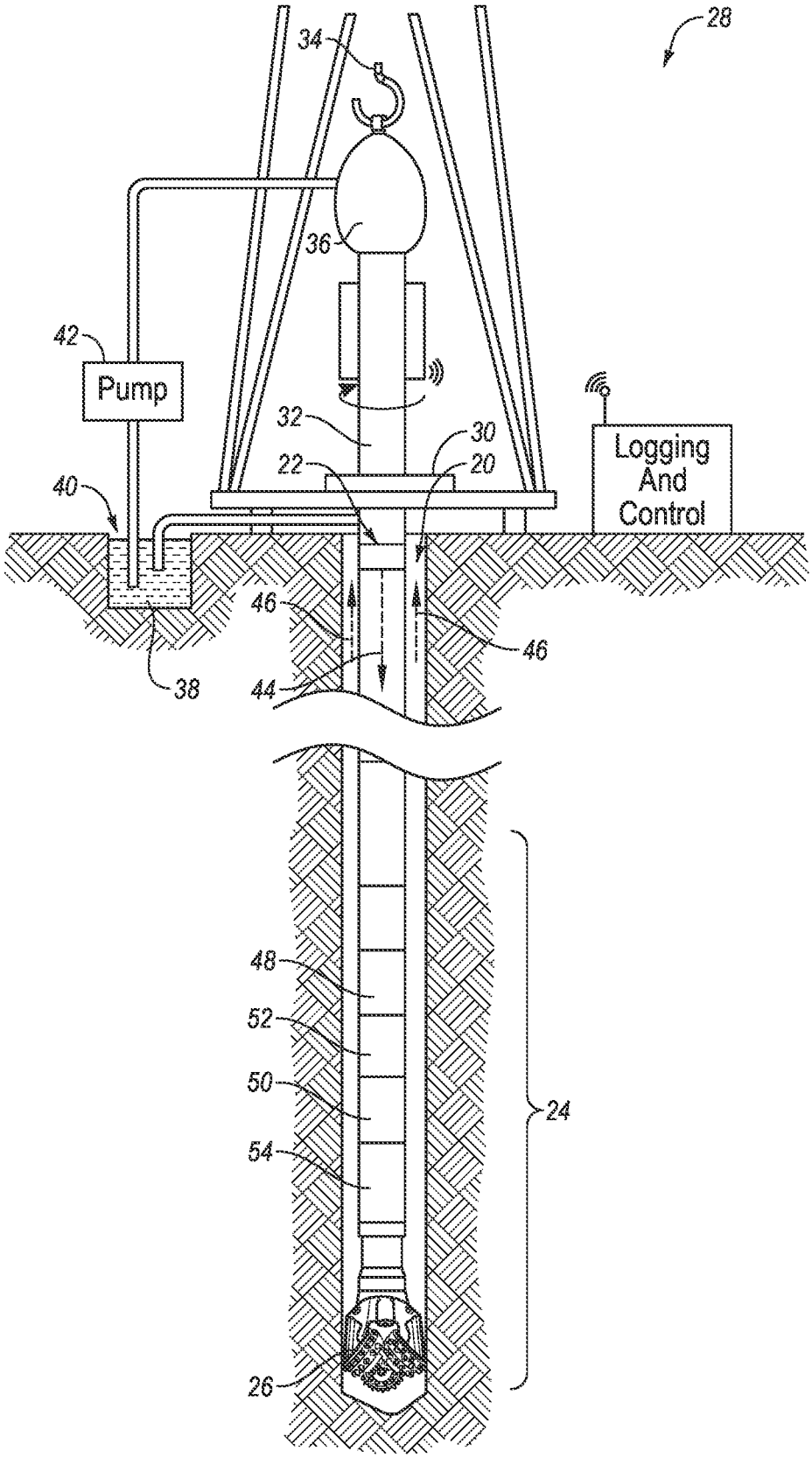
FIG. 1 is a schematic illustration of an example of a drilling system deployed in a wellbore, according to some embodiments of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate improved operation of tools which may be rapidly actuated via hydraulic flow controlled by a valve or valves. For example, the system and methodology may be used in various downhole applications to facilitate the actuation of tools utilized in wellbores or other types of boreholes. Examples of tools which may be combined with the actuation system include rotary steerable systems, mud motors, reamers, jars, flow control subs, and other types of actuatable tools utilized in downhole operations or other operations.

According to some embodiments, the tool, e.g. a downhole tool, utilizes at least one actuator which may be actuated rapidly between positions during operation of the tool. In various downhole applications, the downhole tool may include a plurality of actuators which are individually controlled. Each actuator is moved via flow of an actuating fluid controlled by a main valve which, in turn, may be shifted between operational positions via flow of a portion of the actuating fluid controlled by a corresponding pilot valve. In some applications, individual main valves may be used with corresponding actuators of the tool to provide individual control over that specific actuator. The pilot valve flow has a substantially reduced flow volume relative to the main valve flow, which in some embodiments, may limit potentially deleterious effects on the valve system (e.g., erosion) and/or reduce the power otherwise needed to operate the valve. In some applications, a plurality of pilot valves is associated with a corresponding plurality of main valves. The pilot valve may have a rotary valve type construction or other suitable construction to enable use of a single valve in controlling flow of actuating fluid to a plurality of valves or other devices.

According to some embodiments, a system of main valves and pilot valves is utilized in a mud actuated tool such as a steering tool, e.g. a rotary steerable system. The pilot valve (or pilot valves) may be combined with main mud valves used in, for example, rotary steerable systems. Each pilot valve may be constructed with a relatively small internal piston and corresponding choke or chokes constructed to enable operation of the pilot valve with a relatively low volume flow rate of actuating fluid. In some embodiments, a differential pressure across an internal piston/shuttle of the main valve can be used to automatically open and close the main valve and thus the main supply of actuating fluid. In various downhole applications, the actuating fluid is in the form of drilling mud. The choke or chokes may be arranged to provide self-cleaning of internal volumes exposed to the drilling mud or other hydraulic actuating fluid. In some applications, use of the differential pressure on the internal piston/shuttle enables construction of the pilot valve system without springs.

The valve system may be used to facilitate control over the actuation of a variety of downhole tools, as referenced above, or other types of tools which may utilize rapid and repeated actuation of actuator components. One example of such a tool is a rotary steerable system which may be employed to enable control over a drilling direction during a downhole drilling operation. Referring generally to FIG. 1, an example of a wellsite system in which embodiments described herein may be employed is illustrated. The wellsite may be onshore or offshore. In this example, a borehole 20 is formed in a subsurface formation by drilling. The method of drilling to form the borehole 20 may include, but is not limited to, rotary and directional drilling. A drill string 22 is suspended within the borehole 20 and has a bottom hole assembly (BHA) 24 that includes a drill bit 26 at its lower end.

Some embodiments of a surface system include a platform and derrick assembly 28 positioned over the borehole 20. An example of assembly 28 includes a rotary table 30, a kelly 32, a hook 34 and a rotary swivel 36. The drill string 22 is rotated by the rotary table 30, energized by a suitable system (not shown) which engages the kelly 32 at the upper end of the drill string 22. The drill string 22 is suspended from the hook 34, attached to a traveling block (not shown) through the kelly 32 and the rotary swivel 36 which permits rotation of the drill string 22 relative to the hook 34. Any suitable system may be used, and e.g., a top drive system can be used instead of the kelly.

Some embodiments of the surface system also include a drilling fluid 38, e.g., mud, stored in a pit 40 formed at the wellsite. A pump 42 delivers the drilling fluid 38 to the interior of the drill string 22 via one or more ports in the swivel 36, causing the drilling fluid to flow downwardly through the drill string 22 as indicated by directional arrow 44. The drilling fluid exits the drill string 22 via one or more ports in the drill bit 26, and then circulates upwardly through the annulus region between the outside of the drill string 22 and the wall of the borehole, as indicated by directional arrows 46. In this manner, the drilling fluid lubricates the drill bit 26 and carries formation cuttings and particulate matter up to the surface as it is returned to the pit 40 for recirculation.

The illustrated embodiment of bottom hole assembly 24 includes one or more logging-while-drilling (LWD) modules 48/50, one or more measuring-while-drilling (MWD) modules 52, one or more rotary steerable systems and motors (not shown), and the drill bit 26. It will also be understood that more than one LWD module and/or more than one MWD module may be employed in various embodiments, e.g. as represented at 48 and 50. It should also be noted that some applications may utilize the steering tool without MWD or LWD modules.

The LWD module 48/50 may be housed in any type of drill collar, and includes capabilities for measuring, processing, and storing information, as well as for communicating with the surface equipment. The LWD module 48/50 also may include a pressure measuring device and one or more logging tools.

The MWD module 52 also may be housed in a type of drill collar, and includes one or more devices for measuring characteristics of the drill string 22 and drill bit 26. The MWD module 52 also may include one or more devices for generating electrical power for the downhole system. In some embodiments, the power generating devices include a mud turbine generator (also known as a "mud motor") powered by the flow of the drilling fluid. In other embodiments, other power and/or battery systems may be employed to generate power.

The MWD module 52 also may include one or more of the following types of measuring devices: a weight-on-bit measuring device, a torque measuring device, a vibration measuring device, a shock measuring device, a stick slip measuring device, a direction measuring device, and an inclination measuring device. These measuring devices may be used individually or in various combinations.

In an operational example, the wellsite system of FIG. 1 is used in conjunction with controlled steering or "directional drilling." Directional drilling is the intentional deviation of the wellbore from the path it would naturally take. In other words, directional drilling is the steering of the drill string 22 so that it travels in a desired direction. Directional drilling is, for example, useful in offshore drilling because it allows multiple wells to be drilled from a single platform. Directional drilling also enables horizontal drilling through a reservoir. Horizontal drilling, in turn, enables a longer length of the wellbore to traverse the reservoir, which increases the production rate from the well.

A directional drilling system also may be used in vertical drilling operations. Drill bits may veer off of a planned drilling trajectory because of the unpredictable nature of the formations being penetrated or the varying forces that the drill bit experiences. When such a deviation occurs, a directional drilling system may be used to put the drill bit back on course.

A method of directional drilling includes the use of a steerable tool or subsystem 54, e.g. a rotary steerable system ("RSS"). In some embodiments that employs the wellsite system of FIG. 1 for directional drilling, the steerable tool or subsystem 54 may include the RSS. In this RSS based system, the drill string may be rotated from the surface, and downhole devices cause the drill bit to drill in the desired direction. Rotary steerable systems for drilling deviated boreholes into the earth may be generally classified as either "point-the-bit" systems or "push-the-bit" systems.

In an example of a "point-the-bit" rotary steerable system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition for a curve to be generated. This may be achieved in a number of different ways, including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of "point-the-bit" type rotary steerable systems and their operation are described in U.S. Pat. Nos. 6,394,193; 6,364,034; 6,244,361; 6,158,529; 6,092,610; and 5,113,953; and U.S. Patent Application Publication Nos. 2002/0011359 and 2001/0052428.

In an example of a "push-the-bit" rotary steerable system, there is no specially identified mechanism that deviates the bit axis from the local bottom hole assembly axis. Instead, the requisite non-collinear condition is achieved by causing either or both of the upper or lower stabilizers to apply an eccentric force or displacement in a direction that is orientated with respect to the direction of hole propagation. This may be achieved in a number of different ways, including non-rotating (with respect to the hole) eccentric stabilizers (displacement based approaches) and eccentric actuators that apply force to the drill bit in the desired steering direction. Steering is achieved by creating non co-linearity between the drill bit and at least two other touch points. In its idealized form, the drill bit is forced to cut sideways to generate a curved hole. Examples of "push-the-bit" type rotary steerable systems and their operation are described in U.S. Pat. Nos. 6,089,332; 5,971,085; 5,803,185; 5,778,992; 5,706,905; 5,695,015; 5,685,379; 5,673,763; 5,603,385; 5,582,259; 5,553,679; 5,553,678; 5,520,255; and 5,265,682.

Figure 2:
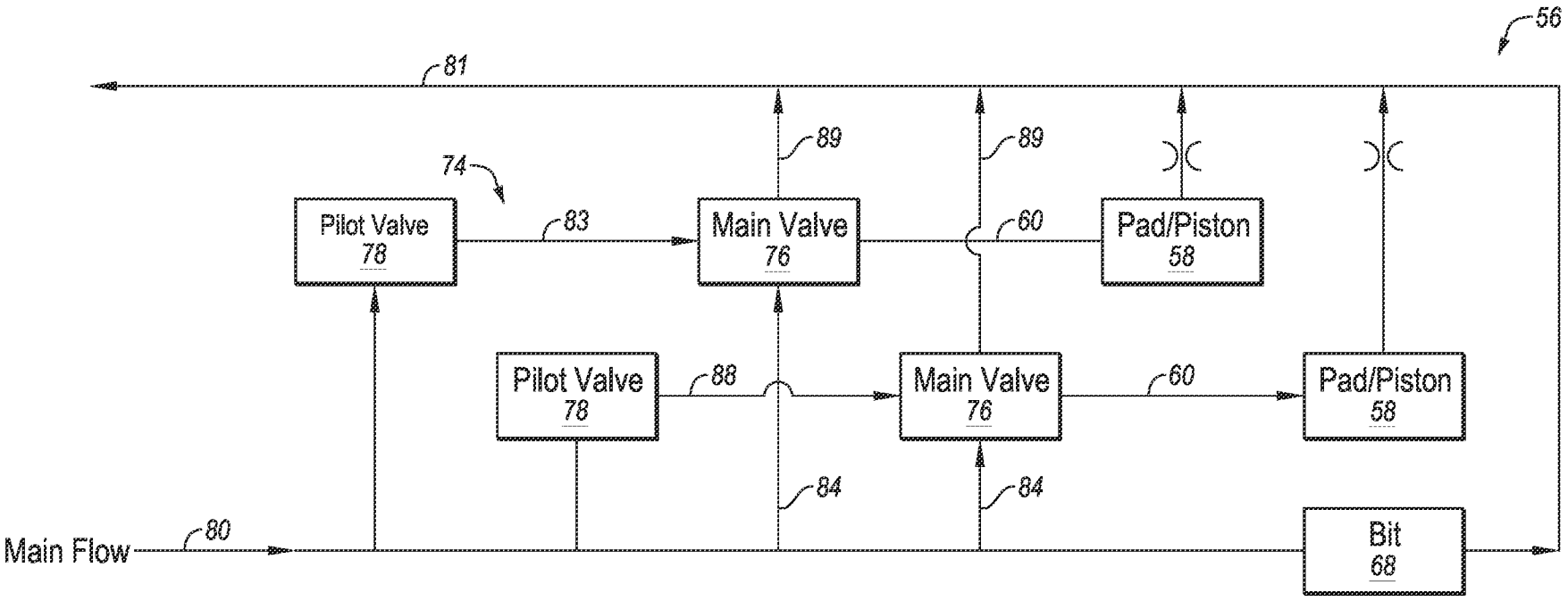
FIG. 2 is a schematic system illustration of an example of a rapidly actuatable downhole tool with a drill bit, according to some embodiments of the disclosure.

Referring generally to FIG. 2, an example of a tool 56 is illustrated as having a component 58, e.g. a plurality of components 58, which may be actuatable rapidly and repeatedly between operational positions via actuating fluid supplied via a main flow line(s) 60. In the specific embodiment illustrated, tool 56 is in the form of steerable tool, e.g. a RSS, and components 58 include actuators oriented for actuation between operational positions. For example, the components/actuators 58 may be pads which include, are coupled with, or are integral with pistons. Selective application of hydraulic actuating fluid, e.g. drilling mud, via main flow lines 60 causes movement of the pistons, and thus pads, in a generally radial direction between a radially inward position and a radially outward position in which the pads are driven against a surrounding borehole wall so as to steer a drill bit 68.

In the illustrated example, drill bit 68 is coupled to a tool body of tool 56 and rotated with tool body during drilling of borehole. During drilling, a drilling mud is flowed through tool 56 via mud passages and then through corresponding passages in drill bit 68 so as to carry away cuttings along the annulus between borehole wall and the overall drill string. Additionally, hydraulic actuating fluid, e.g. a portion of the drilling mud, is directed along selected main flow lines 60 to the desired pistons and corresponding pads via a valve system 74. By way of example, the pads may be arranged at circumferential positions about the tool body so as to enable steering of drill bit 68 by rapidly actuating specific pads or groups of pads at desired angular positions. The pattern of actuating specific pads is selected so as to cause steering of the drill bit 68 along a desired trajectory during drilling.

As illustrated in FIG. 2, some embodiments of valve system 74 include at least one piloted main valve 76. In some applications, a single piloted main valve 76 may be used or individual piloted main valves 76 may be paired with corresponding sets of components 58 or actuators, e.g. pads, or even individual actuators. The example illustrated in FIG. 2 has two sets of pads that can be arranged at equally spaced circumferential positions about tool body and each set of pads is controlled by a corresponding piloted main valve 76. In this example, two piloted main valves 76 are used to control two sets of pads by controlling flow of actuating fluid through each of corresponding main flow lines 60. However, different numbers of main flow lines 60, pads, and piloted main valves 76 may be used as selected for a given operation.

The piloted main valves 76 are shiftable between an open flow position and a closed flow position allowing and restricting flow, respectively, of actuating fluid along the corresponding main flow lines 60. The piloted main valves 76 cooperate with a corresponding pilot valve 78 or pilot valves. For example, each piloted main valve 76 may be selectively shiftable via a corresponding pilot valve 78. The pilot valves 78 are controlled electrically, hydraulically, or by other suitable technique so as to control pressure differentials acting on the corresponding piloted main valves 76. In the illustrated example, the pressure differentials acting on each piloted main valve 76 may be established between an interior of tool 56 and an exterior environment, such as a surrounding borehole annulus 81 between tool 56 and borehole wall.

While using a steerable tool during a drilling operation, drilling mud is flowed under pressure down along the interior of the tool body and through mud passages to drill bit 68. A portion of the drilling mud can serve as actuating fluid and flow to piloted main valves 76 via a filter and main valve flow passages 84. When a piloted main valve 76 is in an open flow position, the actuating fluid/drilling mud flows under pressure from passage 84, through the main valve 76, and into the corresponding main flow line 60 to hydraulically actuate the corresponding component 58. When the piloted main valve 76 is in a closed flow position, the pressurized fluid is not able to flow from passage 84 to the corresponding main flow line 60. Whether a given piloted main valve 76 is in the open flow or closed flow position is controlled by the corresponding pilot valve 78. In some embodiments, the system is configured such that when the pilot valve 78 is in an open flow position, the main valve 76 remains closed, and when the pilot valve 78 is in a closed flow position, the main valve 76 is open.

The pilot valves 78 may be of various types depending on the parameters of a given application. In the illustrated example, the pilot valves 78 are digital pilot valves which are electrically controlled between open flow and closed flow positions. However, the pilot valves 78 may be in the form of rotary valves, poppet valves, or other suitable pilot valves scaled for low flow rates relative to the flow rates used for actuating the components 58. In the embodiment shown, when a pilot valve 78 is shifted to an open flow position, the hydraulic actuating fluid/drilling mud is able to flow through pilot valve 78 and through a pilot flow passage 88 to, for example, a shuttle as discussed in greater detail below. The actuating fluid is under pressure sufficient to shift the shuttle so as to actuate the corresponding piloted main valve 76 to a different operational position, e.g. an open flow position allowing flow of pressurized fluid to the pistons (or other types of components 58 employed in other applications). As also described in greater detail below, fluid flow may move through an exhaust passage 89 extending to, for example, the exterior environment 81 surrounding the tool 56. Thus, each piloted main valve 76 is operated via pressure differentials established between a region of tool interior 80 and another region of tool 56 or an exterior environment 81, e.g. the surrounding annulus. Each piloted main valve 76 may work in cooperation with a corresponding pilot valve 78 which is operated to establish the pressure differentials for shifting the piloted main valve 76 between different operational positions. However, other suitable configurations may be used, and the pilot valve 78 may be in the open flow position when the main valve 76 is in a closed position.

Depending on the parameters of a given application, tool 56 may have a variety of configurations and be constructed for carrying out different types of operations. In some embodiments, the tool 56 is steerable tool 54 and utilizes a chassis for holding pilot valves 78 and piloted main valves 76 in position within the tool body. The chassis also may include an electronic chassis for holding an electronic generator and/or electronics which may be used to control delivery of electric power to pilot valves 78 and/or other electrically powered components.

Figure 3:
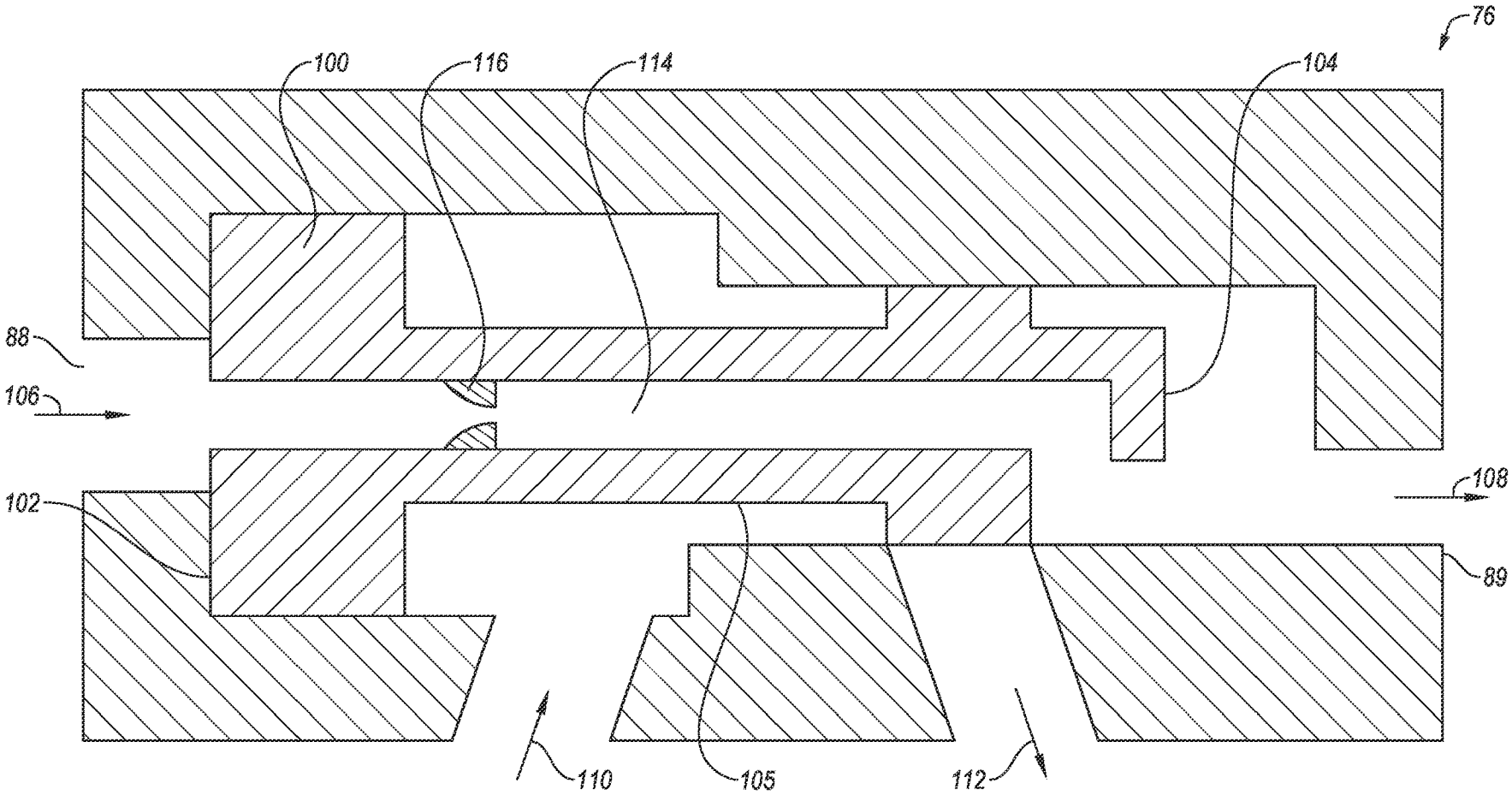
FIG. 3 is an enlarged cross-sectional view of an example of a piloted main valve which may be used in the tool illustrated in FIG. 2, according to some embodiments of the disclosure.

With additional reference to FIG. 3, some embodiments of piloted main valves 76 are illustrated in which the piloted main valves 76 are shifted between operational positions (e.g., the open flow position and the closed flow position) via flow of actuating fluid under control of corresponding pilot valves 78. In this example, each piloted main valve 76 includes a shuttle 100 acted on by the actuating fluid, e.g. drilling mud, supplied via pilot flow passage 88 and controlled via the corresponding pilot valve 78. In this embodiment, the shuttle 100 is a spring-less shuttle which is shifted between operational positions via pressure differentials and without the use of a spring to return the shuttle 100 to a default position. Depending on the embodiment, the shuttle 100 may be exposed to pressures acting on different areas, such as a first side 102, a second or opposite side 104, and a central area 105. The central area 105 may be a generally annular area between sides 102, 104 and exposed to supply pressure. The central area 105 have flanged surfaces proximate the first side 102 and second side 104, respectively, that may generate a force differential on the shuttle 100 when the central area 105 is exposed to a supply pressure. The pressure differential established via the pressures acting on, for example, first side 102, opposite side 104, and central area 105 of the shuttle 100 may be used to cause movement of shuttle 100. The relative surface areas of first side 102 and opposite side 104 may be different to facilitate a desired shifting of the shuttle 100. For example, the first side 102 may have a substantially larger surface area, e.g. 30-100% larger, e.g., 50%, 70%, or 90% larger, than the opposite side 104.

During operation, individual pilot valves are selectively actuated to an open flow position which opens up the corresponding pilot valve ports. Once opened, the pilot valve allows the hydraulic actuating fluid, e.g. drilling mud, to flow through the pilot flow passage 88 and to act against first side 102 of shuttle 100 in the corresponding piloted main valve 76, as represented by the pilot-flow-in arrow 106 in FIG. 3. This causes the shuttle 100 to shift to the right and to force fluid at the second side 104 out into the exhaust passage 89, as represented by pilot-flow-out arrow 108.

After the shuttle 100 is shifted to the open flow position, actuating fluid will be able to flow through the piloted main valve 76, as represented by main-flow-in arrow 110 and main-flow-out arrow 112 in FIG. 3. When the piloted main valve 76 is in the open flow position, the actuating fluid flows through the piloted main valve 76 and out along the corresponding main flow line to the corresponding actuator, e.g. set of pads. In various spring-less shuttle embodiments described herein, the pressures acting on specific areas of the shuttle 100, e.g. first side 102, second side 104, and central area 105, create the pressure differentials which move shuttle 100 in a desired direction. In some embodiments, the central area 105 is exposed to supply pressure which is able to shift the shuttle 100 back to an original position when the corresponding pilot valve 78 is off. By way of example, when the force acting on first side 102 is larger than the forces acting on shuttle 100 at second side 104 and central area 105, the shuttle 100 is moved in the corresponding direction (i.e., in the direction of the second side 104). When the forces acting at second side 104 and central area 105 are larger than the force acting on first side 102, the shuttle 100 is shifted in the opposite direction (i.e., in the direction of the first side 102). In some embodiments, the first side 102 has a sufficiently larger surface area positioned closest to the corresponding pilot valve 78 so that a desired net force can be created in the direction of the second side 104 and opposite to the force resulting from pressure acting on central area 105. The orientation of the cooperating surface areas at first side 102, second side 104, and central area 105 may be selected so the piloted main valve 76 is in a normally open position or a normally closed position. It should be noted the shuttle 100 is illustrated in the closed flow position in FIG. 3.

In some embodiments, the shuttle 100 also may include a shuttle flow passage 114 having a choke 116. The shuttle flow passage 114 protects against trapping of a volume of fluid which would prevent the shuttle 100 from moving. The shuttle flow passage 114 and choke 116 also may be sized to control the rate of flow through the shuttle 100 and thus the buildup of pressure against first side 102 when the corresponding pilot valve is actuated. In this type of embodiment, the choke 116 and shuttle flow passage 114 allow a continued flow through the shuttle 100 of piloted main valve 76 along the flow path indicated by the pilot-flow-in arrow 106 and the pilot-flow-out arrow 108. The use of shuttle flow passage 114 and choke 116 also allows regular, e.g., continuous, flushing which prevents accumulation of particles that could otherwise lead to jamming of tool components. It should be noted the shuttle 100 may include appropriate seal features, which selectively blocks or enables flow through an outlet port or ports as the shuttle 100 is shifted between operational positions.

Depending on the parameters of a given application, the number of piloted main valves and pilot valves may vary.

Many types of tools may benefit from the ability to rapidly and repeatedly actuate a component or components. In some applications, a single pilot valve may be paired with a single piloted main valve, although other numbers of valves may be used. In a rotary steerable system, for example, the number of piloted main valves and piloted valves may correspond to the number of steering actuators (e.g., pads or pistons). In some embodiments, an individual pilot valve, e.g. a rotary pilot valve, may be used to enable control over one or more than one corresponding piloted main valve. Other features also may be added to the valve system. For example, an exhaust valve may be added to exhaust the hydraulic actuating fluid acting on a given piston after the corresponding piloted main valve has shifted to the closed position.

Figure 4:
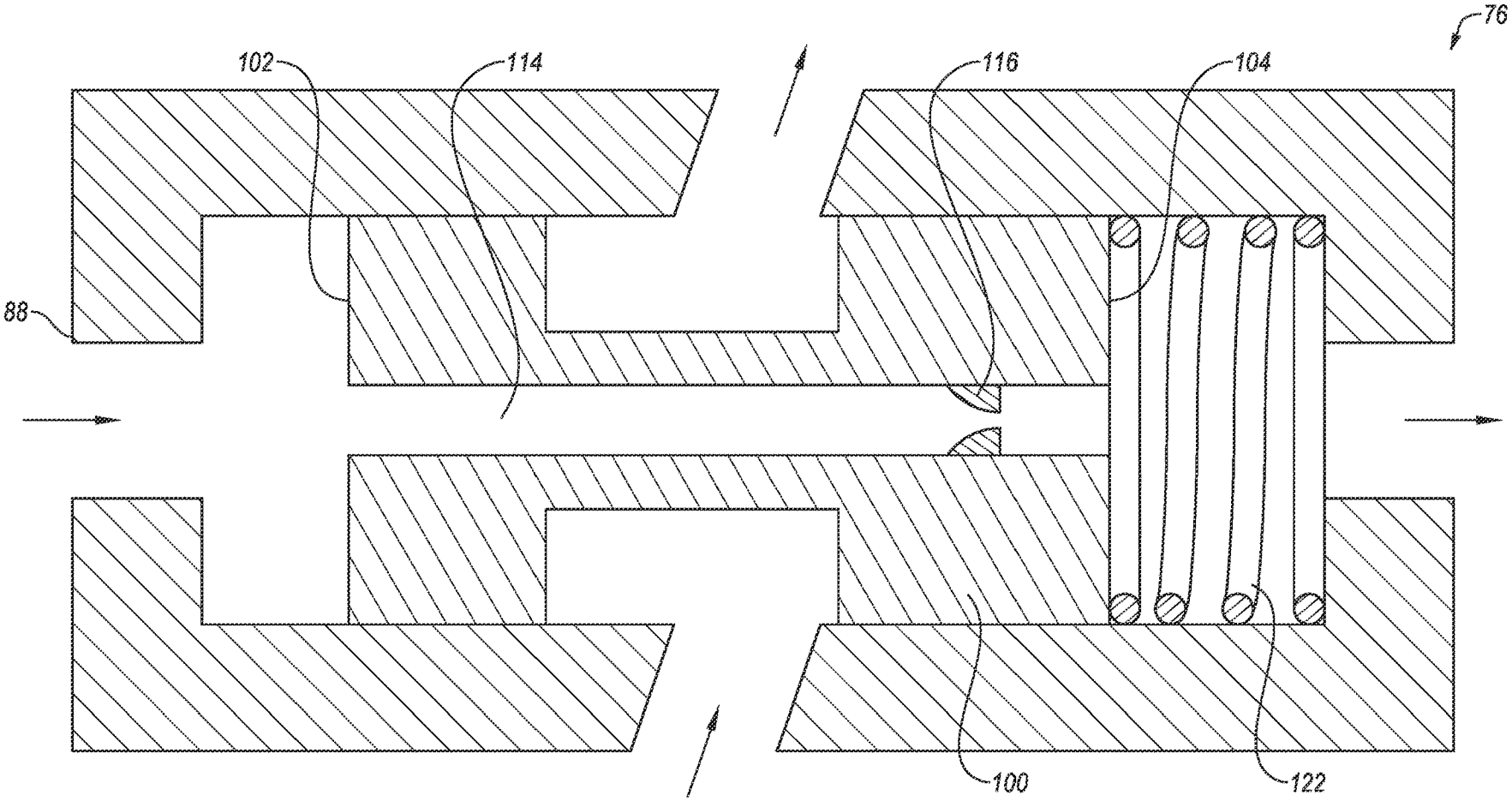
FIG. 4 is an enlarged cross-sectional view of an example of a piloted main valve which may be used in the tool illustrated in FIG. 2, according to some embodiments of the disclosure.

Referring generally to FIG. 4, another embodiment of valve system is illustrated. In this embodiment, each piloted main valve 76 is spring-loaded via a spring member 122 acting against the second or opposite side 104 of shuttle 100. In this example, the shuttle 100 again includes shuttle flow passage 114 which serves as a nozzle able to create a pressure difference between the first side 102 and the opposite side 104 of shuttle 100 when flow is received from the corresponding pilot valve.

For example, when the corresponding pilot valve 78 is in an open position enabling flow along pilot flow passage 88, a differential pressure is created and pushes the shuttle 100 to the right. Movement of the shuttle 100 to the right effectively shifts the shuttle 100 and thus the piloted main valve 76 to an open flow position, as illustrated in FIG. 4. In this open flow position, the supply of hydraulic actuating fluid, e.g. drilling mud from the main flow path, can flow through the piloted main valve 76 and to the corresponding actuator via the corresponding main flow line.

When the pilot valve is actuated to a closed position, the spring member 122 applies a restoring force and returns the shuttle 100 to the left and closes the piloted main valve 76. Actuating fluid between the pilot valve and the shuttle 100 is able to exhaust through the shuttle flow passage 114. As described above, various chokes 116 may be used along the shuttle flow passage 114 to, for example, help control the speed of the shuttle 100 during opening and/or closing.

Figure 5:
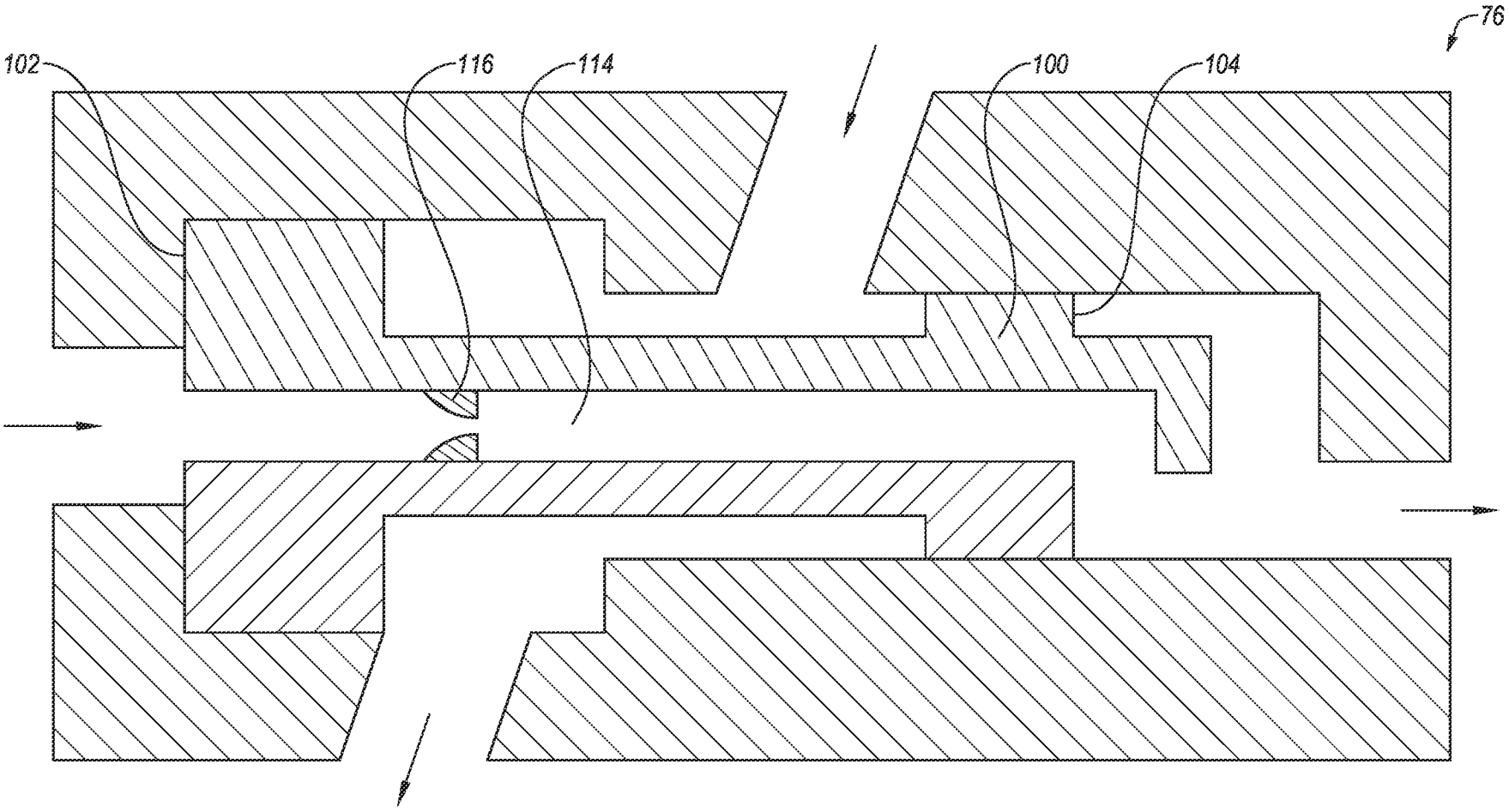
FIG. 5 is an enlarged cross-sectional view of an example of a piloted main valve which may be used in the tool illustrated in FIG. 2, according to some embodiments of the disclosure.

Referring generally to FIG. 5, another embodiment of a valve system is illustrated. In this embodiment, the valve system is in a normally open position and each piloted main valve 76 again includes shuttle 100. The illustrated shuttle 100 is a spring-less shuttle and operates without a spring member. However, the first side 102 of the shuttle 100 may have a different diameter and different cross-sectional area relative to the second or opposite side 104 of the shuttle 100. The supply pressure controlled by the corresponding pilot valve acts in one direction on the shuttle 100 to enable selective actuation of the piloted main valve 76.

In this embodiment, when the corresponding pilot valve closes and the supply pressure is reduced, the internal pressure (or other suitable pressure) acts on shuttle 100 to shift the shuttle 100 and thus main valve 76 back to the original position, e.g. the open position, illustrated in FIG. 5. In other words, in this embodiment, when the pilot valve is closed, the main valve 76 is open. In this embodiment and other embodiments described herein, a controllable choke 116 may be located along the flow passage 114 through shuttle 100. The controllable choke 116 may be used to facilitate shifting of main valve 76 and to enable a controlled restriction of flow along the shuttle flow passage 114 so as to reduce an overall leakage rate of hydraulic actuating fluid, e.g. drilling mud, through the valve system.

Figure 6:
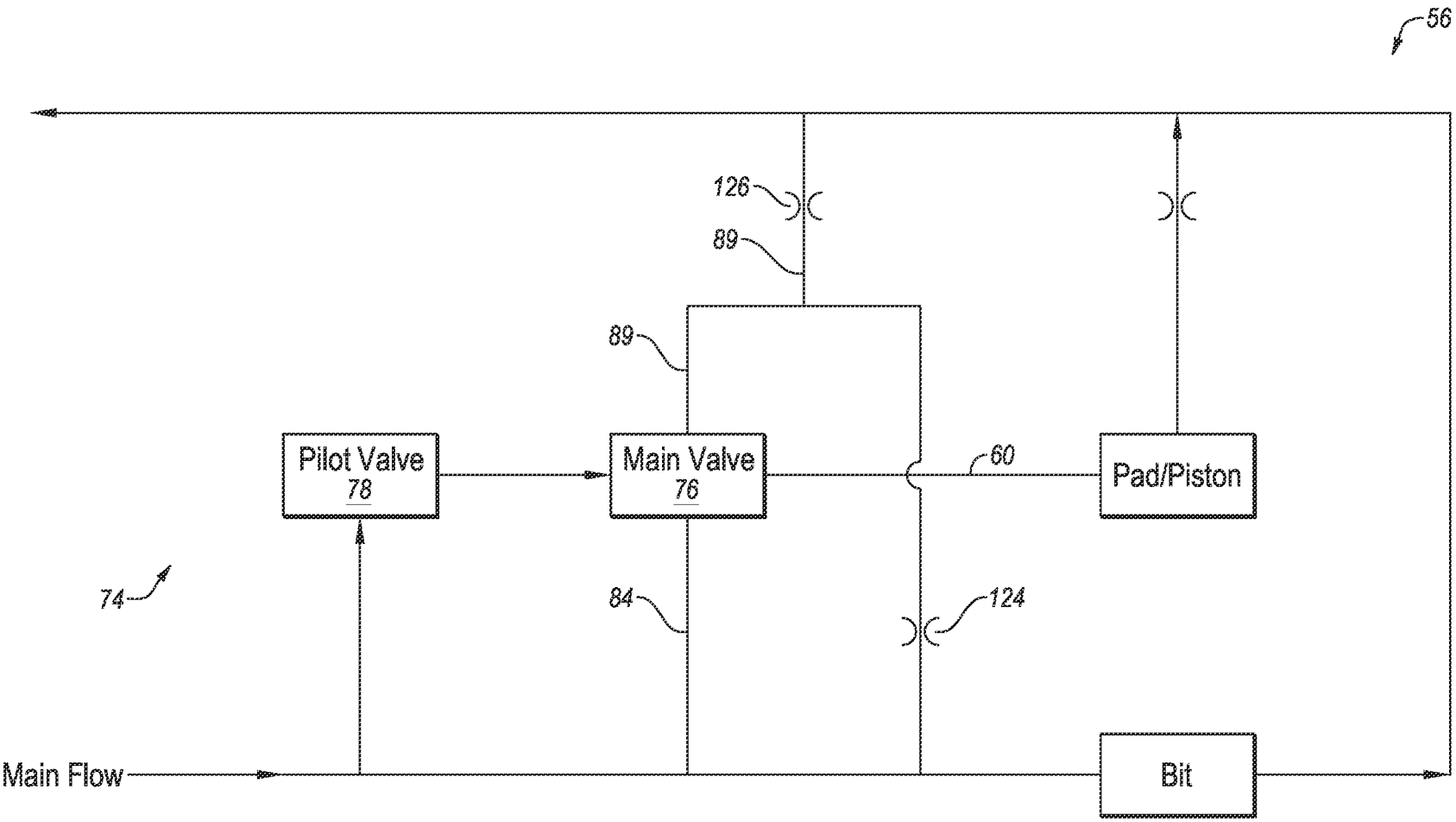
FIG. 6 is a schematic system illustration of an example of a rapidly actuatable downhole tool with a drill bit, according to some embodiments of the disclosure.

Referring generally to FIG. 6, another embodiment of a tool 56 and valve system 74 is illustrated. In this embodiment, various chokes may be used to control back pressure, e.g. pilot line back pressure. Additionally, a choke 124 may be located between the main valve flow passage 84 and the exhaust passage 89 to maintain a minimum pressure within the exhaust passage 89. Maintaining this minimum pressure limits a maximum differential pressure experienced by the pilot valve 78 when closed, thus reducing the forces for opening the pilot valve 78. The embodiment shown in FIG. 6, and any of the disclosed embodiments could have the pilot valve and/or piloted main valve oriented axially within the tool.

In some embodiments, the exhaust passages 89 from the plurality of piloted main valves 76 may be merged before passing through an additional choke 126, e.g. a nozzle, positioned at an outlet end of the exhaust passage 89 proximate the surrounding annulus 81. In some embodiments, the additional choke 126 helps reduce the complexity of the porting, creates a back pressure, and limits the total leakage rate through the valve system 74. Some embodiments may include a pressure sensor assembly for monitoring pressures along selected flow passages.

Figure 7:
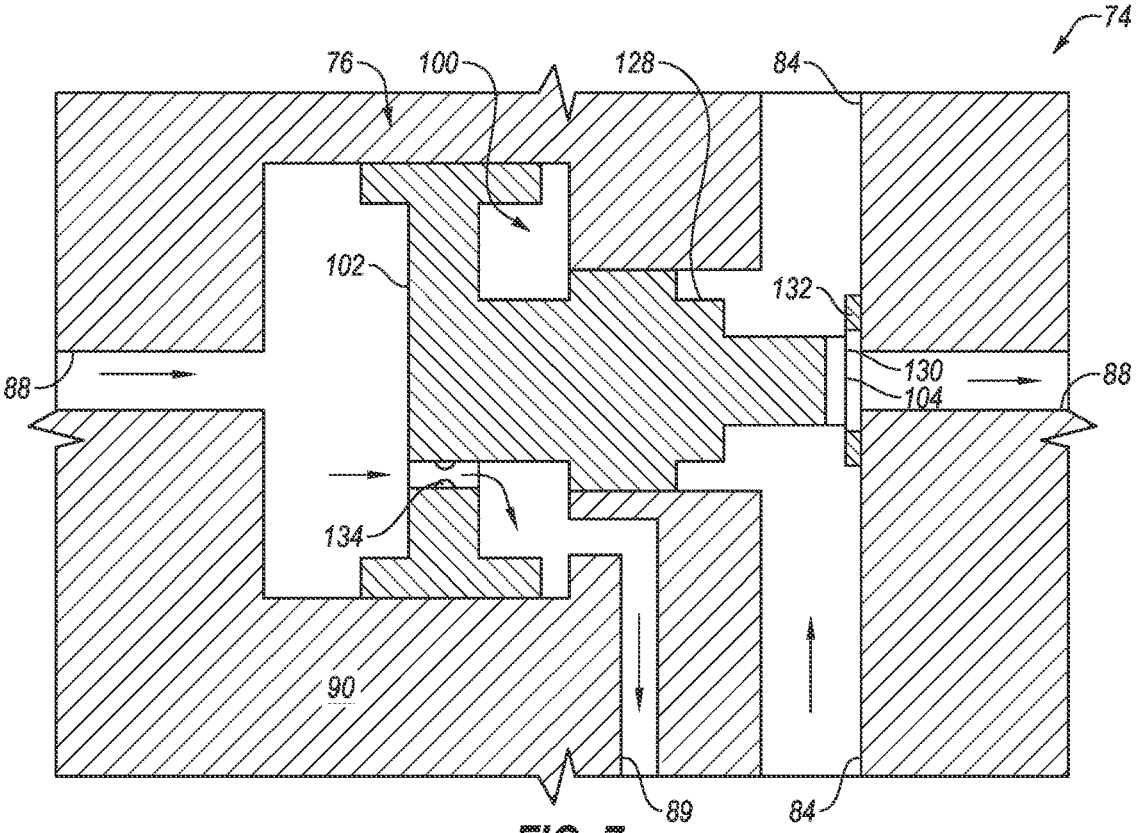
FIG. 7 is a schematic illustration of another example of a tool having a piloted main valve for controlling actuation of a component between operational positions, according to some embodiments of the disclosure.

Referring generally to FIG. 7, another embodiment of a valve system 74 is illustrated. This embodiment provides a configuration utilizing a spring-less shuttle which is normally open. In this embodiment, each piloted main valve 76 includes a shuttle 100 in the form of a poppet valve 128. The poppet valve 128 includes a poppet end 130 which may be moved into and out of sealing engagement with a corresponding seal member 132 so as to block or allow flow of actuating fluid between the main valve flow passage 84 and the main flow line 60 extending to the corresponding component 58, e.g. pad.

In this example, the poppet valve 128 similarly includes various pressure regions having differing diameters and different surface areas. The different surface areas work in cooperation with a choke 134 through valve 128 to create the desired differential pressures based on the flow or no flow position of the corresponding pilot valve. As with other embodiments described herein, the differential pressures may be created between an interior of the tool, as controlled by the corresponding pilot valve, and another pressure region, such as the external pressure region in annulus surrounding the tool.

Figure 8:
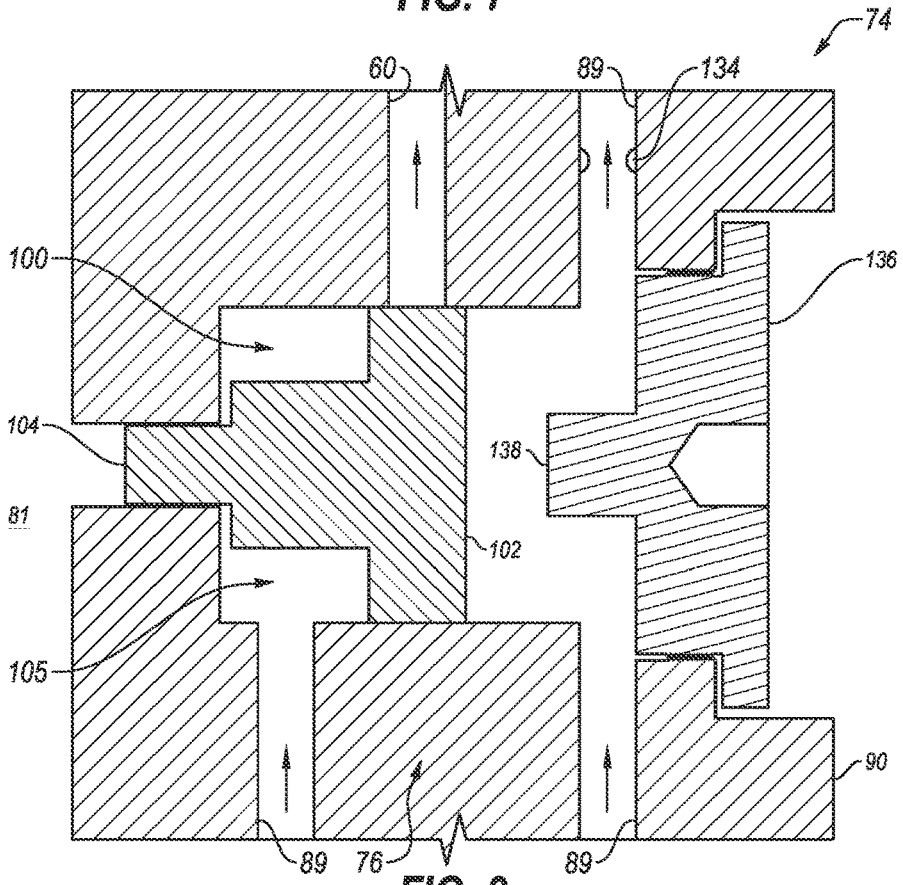
FIG. 8 is a schematic illustration of another example of a tool having a piloted main valve for controlling actuation of a component between operational positions, according to some embodiments of the disclosure.

Referring generally to FIG. 8, another embodiment of a valve system 74 is illustrated. This embodiment provides a configuration utilizing a spring-less shuttle which is nominally open. In this example, each piloted main valve 76 includes shuttle 100. However, rather than choking fluid flow through the shuttle 100, this embodiment simply uses pressure in annulus 81 acting on the second side 104 of the shuttle 100, pilot pressure on the first side 102 of the shuttle 100, and pressure acting on central area 105 as illustrated. The pressure of the actuating fluid supplied under the control of the corresponding pilot valve 78 acts against a larger surface area of the first side 102 relative to the surface area of the second side 104. The different surface areas are again selected to enable the forces resulting from pressures acting on sides 102, 104 and central area 105 to cause the desired shifting of shuttle 100.

As with other embodiments described herein, the corresponding pilot valve may be operated to control the pressure differential between the tool interior and another suitable region, such as the annulus. The pressure differential acts on shuttle 100 so as to shift the shuttle between a closed flow position (as illustrated) when the pilot valve is open, and an open flow position (sliding to the right) when the pilot valve is closed. An appropriate choke 134 may be positioned in the exhaust passage 89 to enable controlled pressure buildup against shuttle 100 when actuating fluid is supplied via the corresponding pilot valve 78. In the specific embodiment illustrated, a plug 136 is positioned in the chassis 90 and located such that an abutment 138 is able to limit travel of shuttle 100. The embodiment illustrated is structured to minimize closed volumes and to thus minimize areas susceptible to buildup of particles. Actuating fluid in the main flow lines 60 may be exhausted through the shuttle 100 or through a separate flow line.

Figure 9:
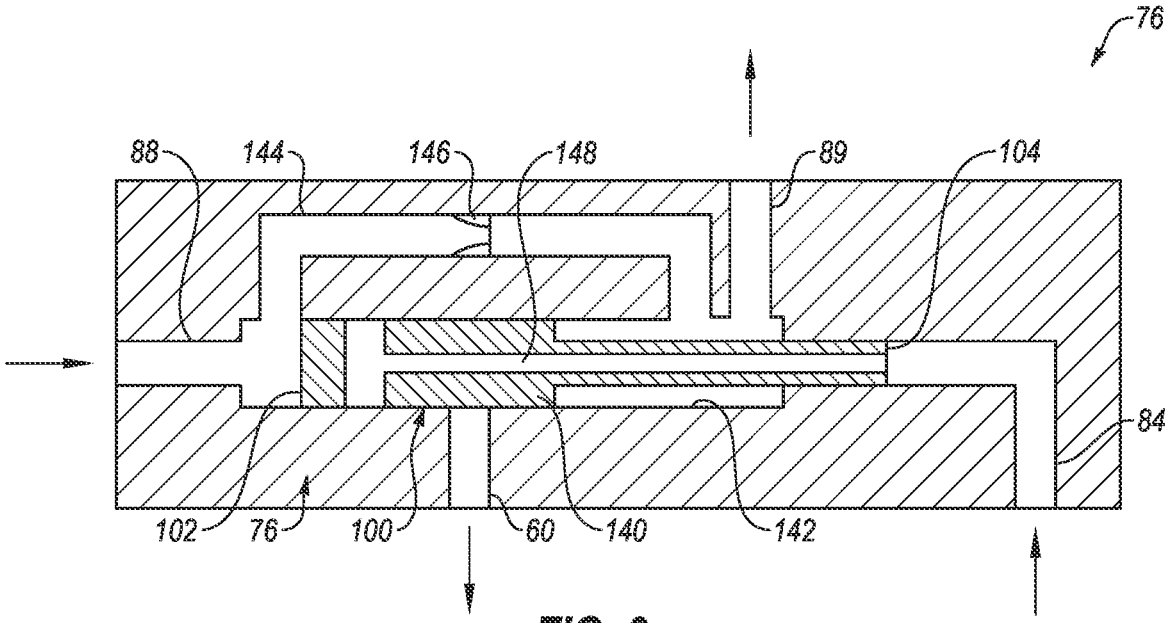
FIG. 9 is a schematic, cross-sectional illustration of an example of a piloted main valve positioned in a tool, according to some embodiments of the disclosure.
Figure 10:
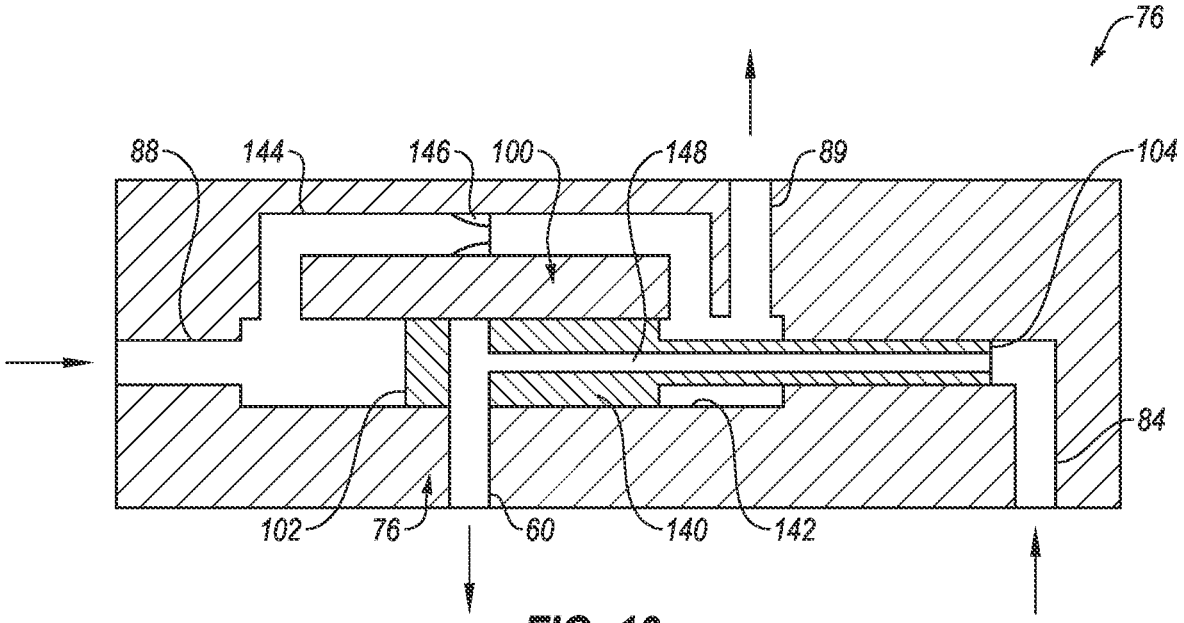
FIG. 10 is a schematic, cross-sectional illustration similar to that of FIG. 11 but showing the piloted main valve in a different operational position, according to some embodiments of the disclosure.

Referring generally to FIGS. 9 and 10, another embodiment of piloted main valve 76 is illustrated. In this embodiment, the shuttle 100 is in the form of a piston 140 slidably received in a corresponding piston cavity 142. The piston 140 similarly has a first side 102 and an opposite side 104 of differing surface areas. A pilot bypass 144 is in fluid communication with piston cavity 142 on opposite sides of the larger first side 102 and includes a choke 146.

Additionally, the piston 140 includes an internal piston flow passage 148 through which actuating fluid may flow to the actuator 58, e.g. pad 62. In FIG. 9, the shuttle 100/piston 140 is located in a closed or no-flow position. However, when the corresponding pilot valve is opened, pressurized actuating fluid is directed against first side 102 and causes the piston 140 to shift to an open, flow position. In this position, high pressure actuating fluid, e.g. drilling mud, is able to flow through the piloted main valve 76 to the corresponding component 58 as illustrated in FIG. 12.

Figure 11:
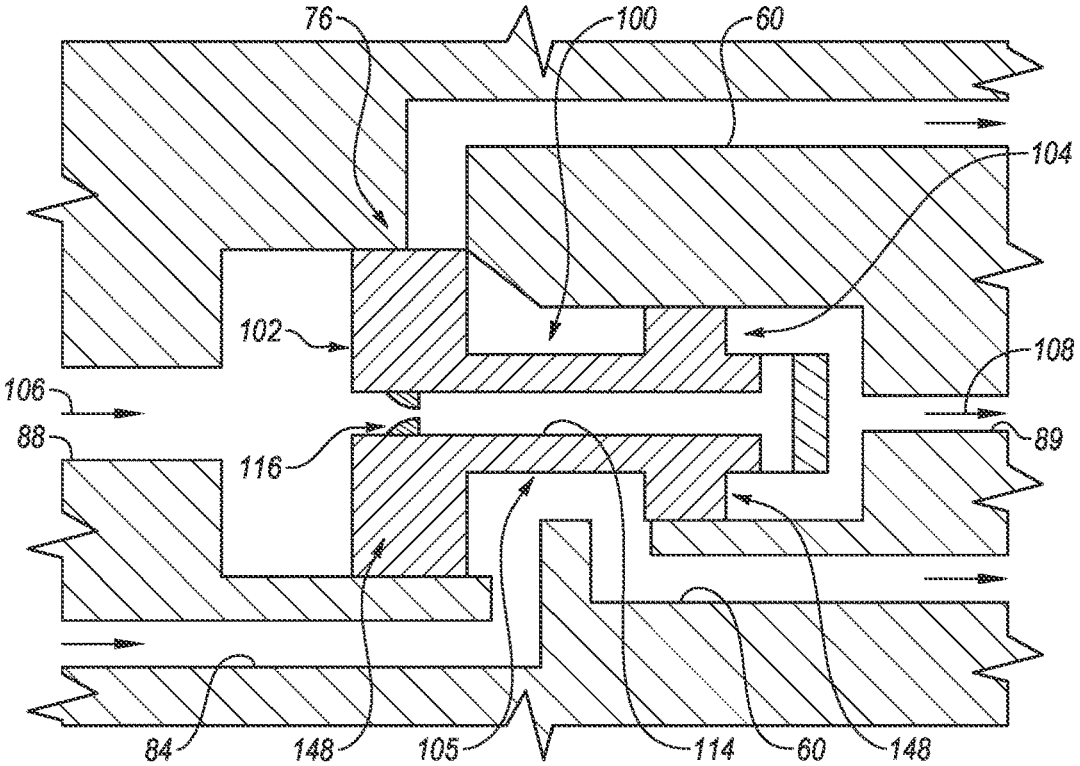
FIG. 11 is a schematic illustration of another example of a tool having a piloted main valve for controlling actuation of a component between operational positions, according to some embodiments of the disclosure.

Referring generally to FIG. 11, another embodiment of tool and valve system is illustrated. This embodiment provides a configuration utilizing a spring-less shuttle which enables the valve system to function as a double shuttle valve. In this example, each piloted main valve 76 again includes shuttle 100 and choke 116 is provided along shuttle flow passage 114. The pressure of the actuating fluid supplied under the control of the corresponding pilot valve acts against a larger surface area of the first side 102 relative to the surface area of the second side 104. The different surface areas are again selected to enable the forces resulting from pressures acting on sides 102, 104 and central area 105 to cause the desired shifting of shuttle 100.

However, the shuttle 100 includes two radially expanded sealing portions 148 of different diameters. The shuttle sealing portions 148 are positioned so as to block or allow flow through a plurality of flow lines 60, e.g. two flow lines 60. In this manner, the flow of actuating fluid along actuating fluid passage 84 may be directed out through the desired flow line 60 of, for example, the illustrated pair of flow lines 60. As with other embodiments, the corresponding pilot valve 78 is operated to control the pressure differential acting on the shuttle 100 so as to shift the shuttle 100 to a desired position allowing outflow of actuating fluid to the desired flow line 60. Fluid from pilot valve 78 may be exhausted through pilot exhaust passage 89.

Figure 12:
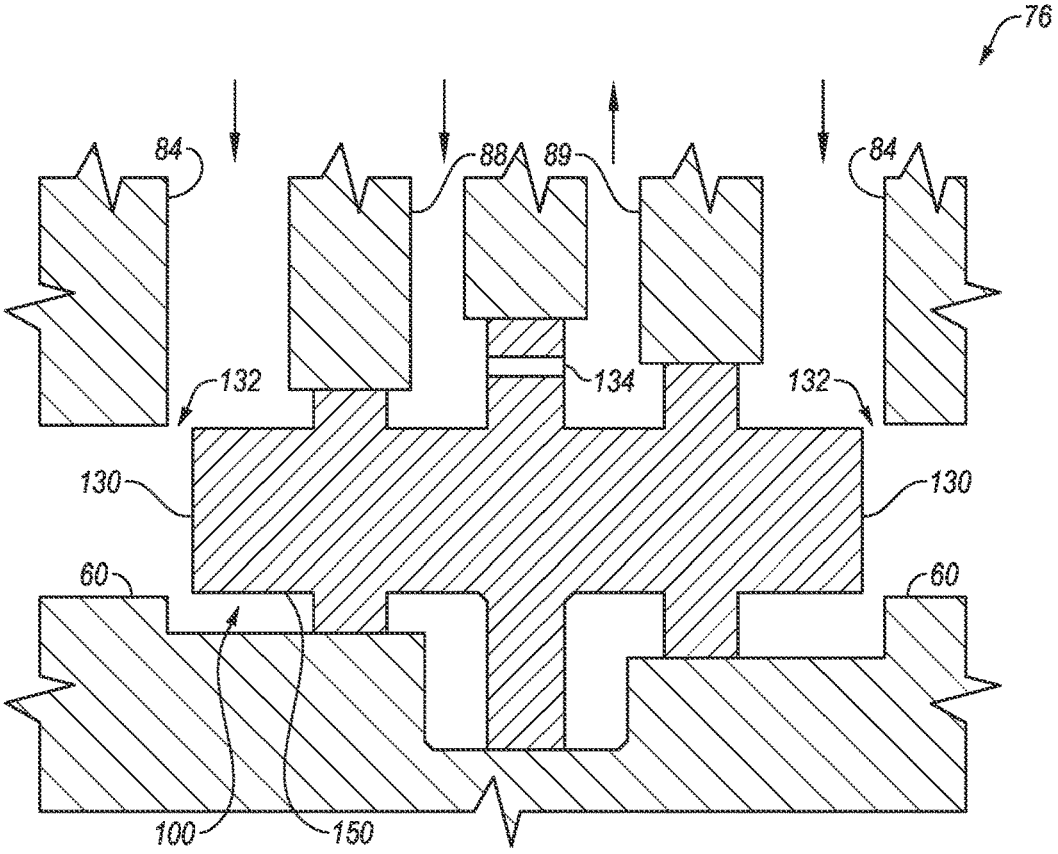
FIG. 12 is a schematic illustration of another example of a tool having a piloted main valve for controlling actuation of a component between operational positions, according to some embodiments of the disclosure.

Referring generally to FIG. 12, another embodiment of tool 56 and valve system 74 is illustrated. This embodiment provides a configuration utilizing a spring-less shuttle similar to that described with reference to FIG. 7. However, the shuttle 100 is in the form of a double poppet valve 150 having two poppet ends 130 which may be moved into and out of sealing engagement with two corresponding seal members 132, e.g. seal surfaces. This allows the shuttle 100 to be selectively moved into and out of sealing engagement for controlling flow of actuating fluid to a desired flow line 60 of a pair of flow lines 60. By way of example, the shuttle may be shifted so as to block or allow flow from a first actuating fluid passage 84 to a first flow line 60 or from a second actuating fluid passage 84 to a second flow line 60.

Figure 13:
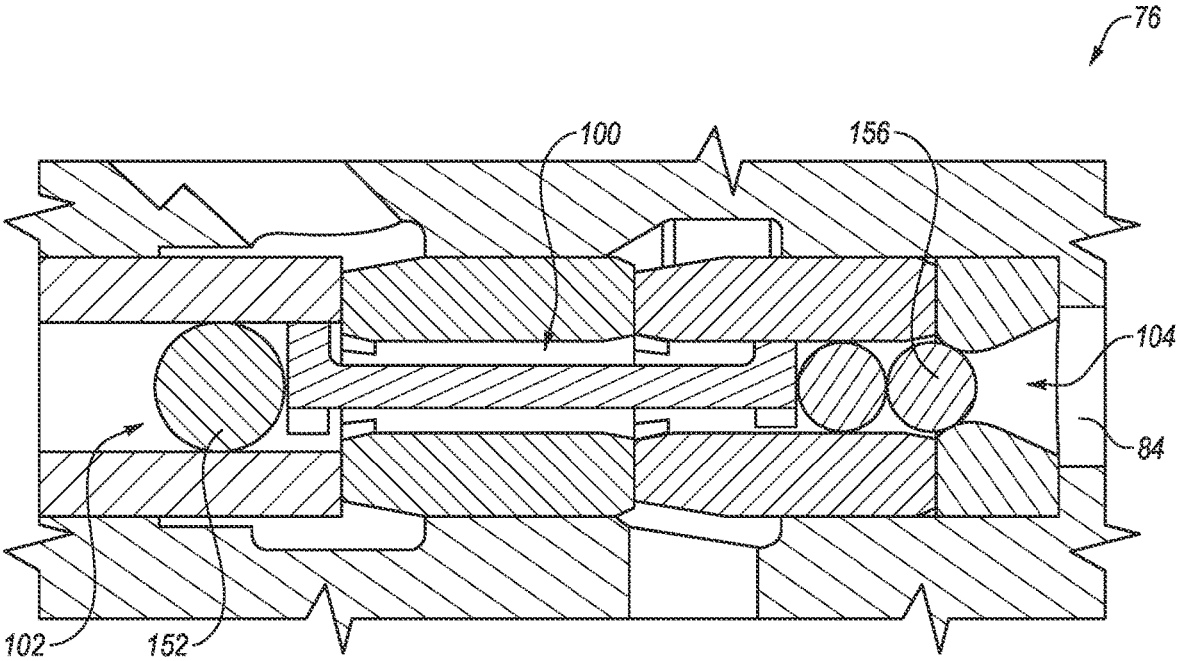
FIG. 13 is a schematic illustration of another example of a tool having a piloted main valve for controlling actuation of a component between operational positions, according to some embodiments of the disclosure.
Figure 14:
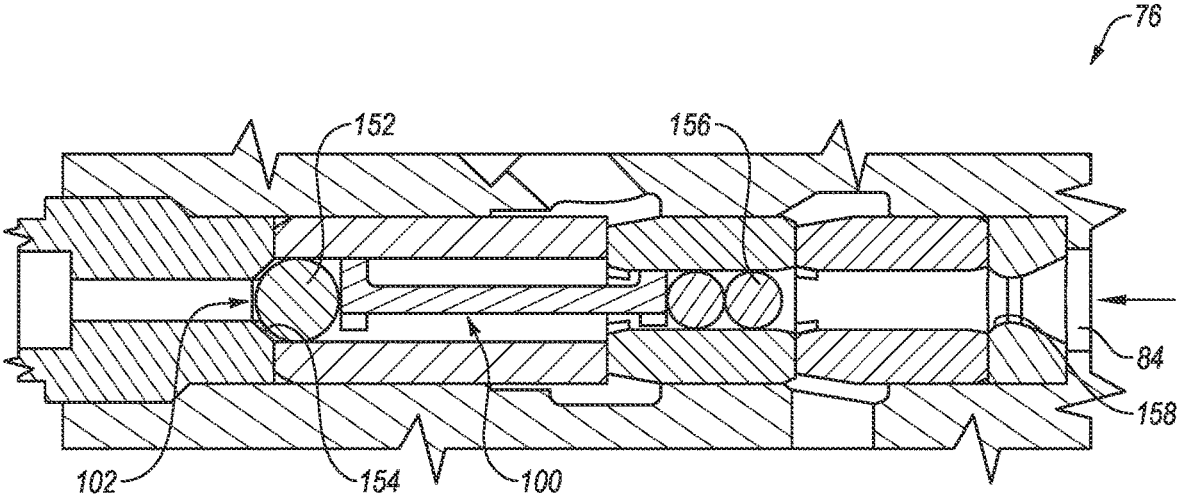
FIG. 14 is a schematic illustration similar to FIG. 15 but showing the piloted main valve in a different operational position, according to some embodiments of the disclosure.

Referring generally to FIGS. 13 and 14, another embodiment of tool 56 and valve system 74 is illustrated. The shuttle 100 includes various pressure regions having differing diameters and different surface areas, e.g. the different surface areas of first side 102 and second side 104. In this example, the first side 102 includes at least one spherical end 152 positioned for sealing engagement with a corresponding seat 154. Similarly, the second side 104 includes at least one spherical end 156 positioned for sealing engagement with a corresponding seat 158.

Pilot valve(s) 78 once again may be operated to control a differential pressure across the shuttle 100 to automatically open and close a main flow of the actuating fluid, e.g. drilling mud, to the corresponding actuators 58, e.g. pads 62. In FIG. 13, the corresponding pilot valve 78 has been actuated, e.g. opened, to supply high-pressure fluid to shuttle 100 via pilot flow passage 88. The high-pressure fluid effectively shifts shuttle 100 to the position illustrated such that end 156 sealably engages corresponding seat 158. Consequently, the flow of actuating fluid from actuating fluid passage 84 to flow line 60 is closed off and the corresponding pads 62 are deactivated. When the pilot valve 78 is closed, the high-pressure actuating fluid, e.g. drilling mud, is able to shift shuttle 100 until end 152 sealably engages corresponding seat 154, as illustrated in FIG. 14. In this position, the actuating fluid is free to flow in from actuating fluid passage 84 and out to the corresponding flow line 60 to activate the corresponding pads 62. The different surface areas of ends 152, 156 create the desired differential pressures based on the flow or no flow position of the corresponding pilot valve 78.

Figure 15:
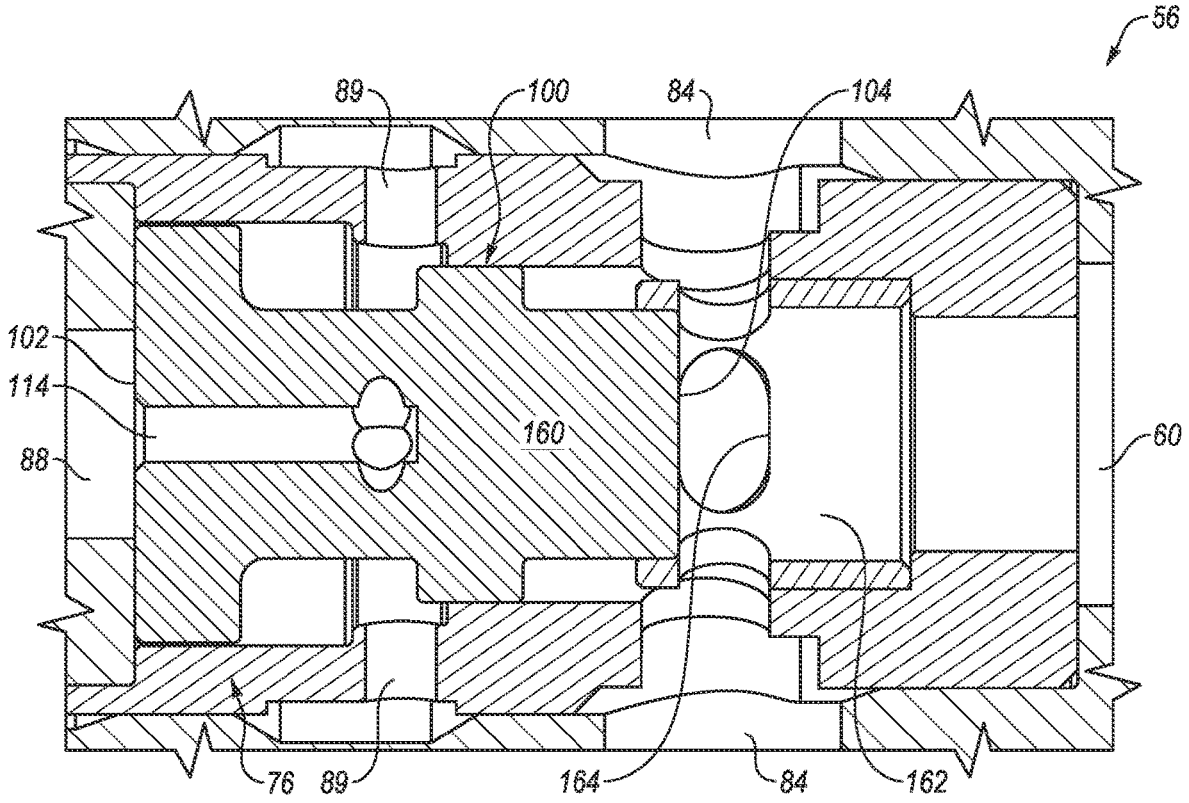
FIG. 15 is a schematic illustration of another example of a tool having a piloted main valve for controlling actuation of a component between operational positions, according to some embodiments of the disclosure.

Referring generally to FIG. 15, another embodiment of tool 56 and piloted main valve 76 is illustrated. This embodiment utilizes a spring-less shuttle similar to poppet embodiments described above. However, instead of using a poppet valve, the shuttle 100 is in the form of a shear valve 160 which slides at least partially within a corresponding sleeve 162. The sleeve 162 includes holes 164 for conducting flow between actuating fluid passages 84 and flow line 60. Movement of the shear valve 160 within corresponding sleeve 162 enables selective closing or opening of the fluid passage holes 164. Thus, the shuttle 100/shear valve 160 may be selectively moved into and out of sealing engagement over holes 164 for controlling flow of actuating fluid.

Figure 16:
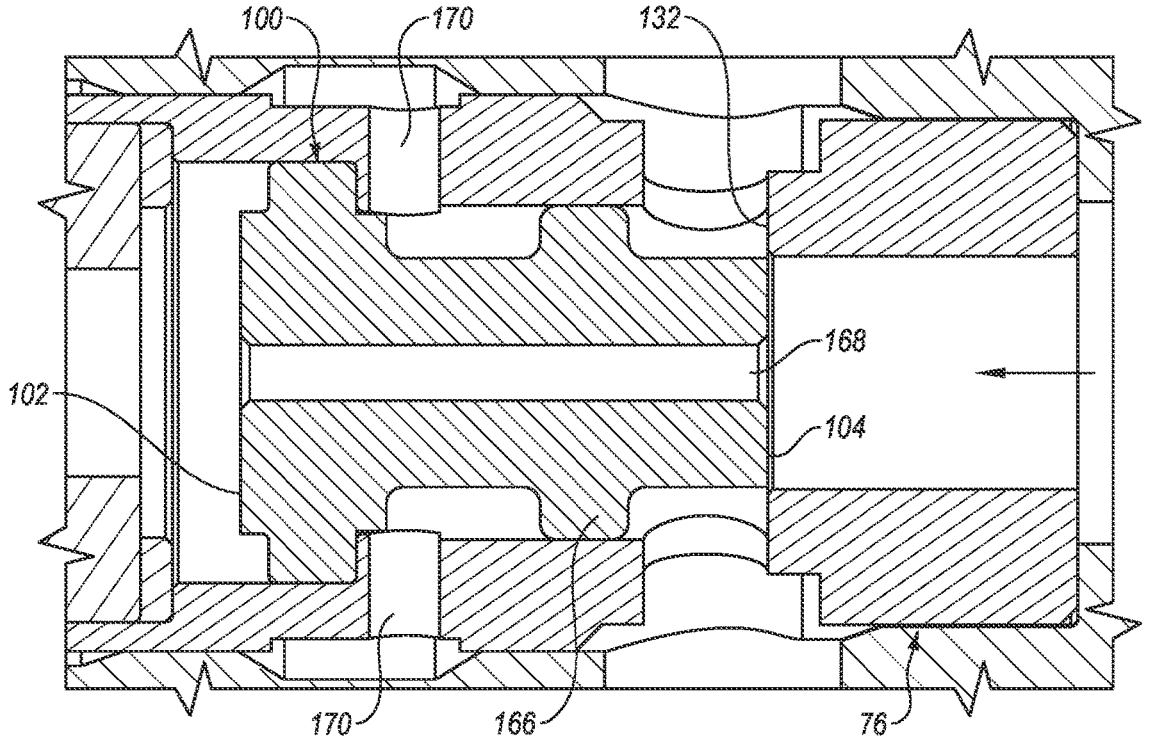
FIG. 16 is a schematic illustration of another example of a tool having a piloted main valve for controlling actuation of a component between operational positions, according to some embodiments of the disclosure.

Referring generally to FIG. 16, another embodiment of tool 56 and piloted main valve 76 is illustrated. This embodiment utilizes a spring-less shuttle 100 in the form of a stagnation pressure poppet valve 166 which may be moved into and out of sealing engagement with a corresponding seal member 132, e.g. seal surface. The stagnation pressure poppet valve 166 may have an internal longitudinal passage 168 extending between the larger surface area at first side 102 and the smaller surface area at second side 104.

In this embodiment, fluid flow is in an opposite direction compared to, for example, the poppet valve embodiment illustrated in FIG. 7. When the poppet valve 166 is closed, the stagnation pressure on the illustrated right side (second side 104) transfers to the larger diameter region on the illustrated left side (first side 102). When the poppet valve 166 is open, flow is allowed to exhaust and thus create low pressure on the illustrated left side of poppet valve 166. The illustrated central area 105 of the shuttle 100/poppet valve 166 may be open to atmosphere, e.g. open to the annulus, via passages 170. Accordingly, the shuttle 100/poppet valve 166 may be selectively shifted so as to block or allow flow between actuating fluid passages 84 and flow line 60.

Figure 17:
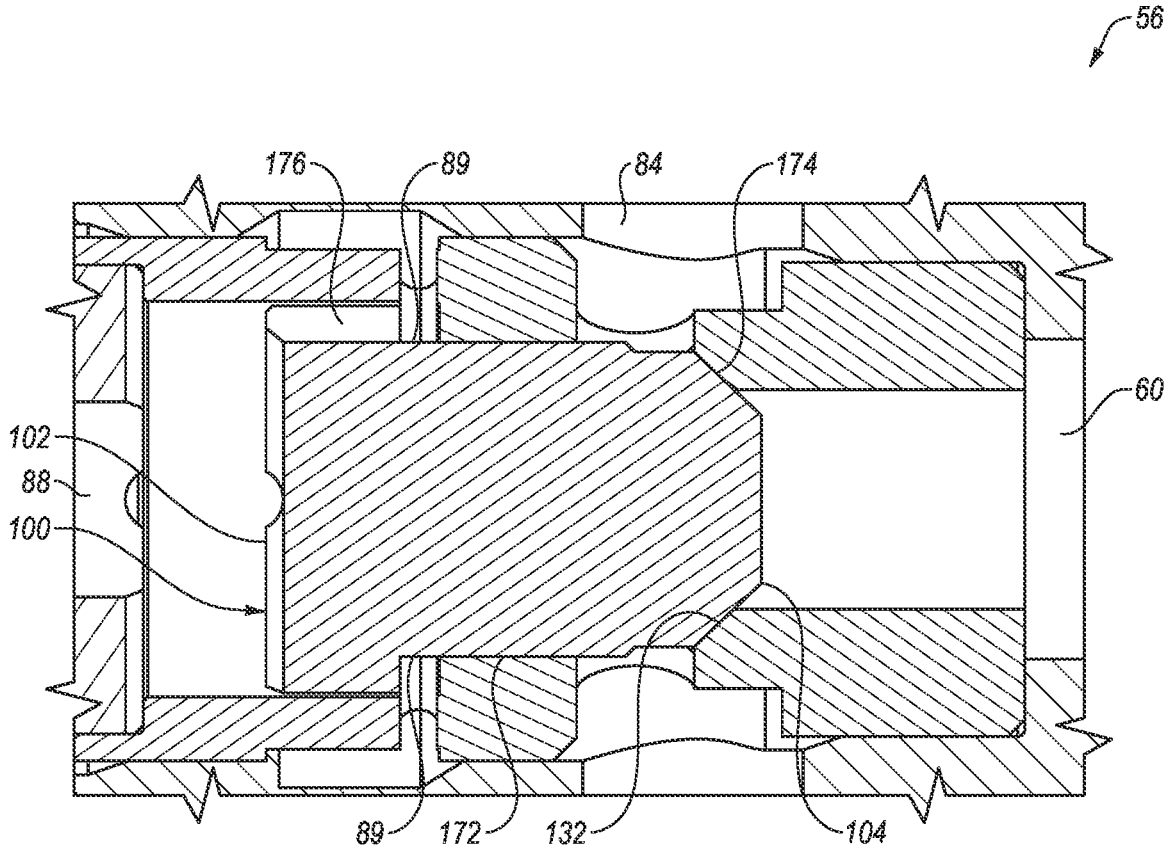
FIG. 17 is a schematic illustration of another example of a tool having a piloted main valve for controlling actuation of a component between operational positions, according to some embodiments of the disclosure.

Referring generally to FIG. 17, another embodiment of tool 56 and piloted main valve 76 is illustrated. This embodiment utilizes a spring-less shuttle 100 similar to that described with reference to FIG. 9. However, the shuttle 100 is in the form of a chamfered poppet valve 172 having a chamfered surface 174 which may be moved into and out of sealing engagement with corresponding seal member 132, e.g. seal surface.

The chamfered poppet valve 172 may include internal flow passages (see flow passage 114 in FIG. 11) routed to desired external regions along the poppet valve 172. In the example illustrated, however, flow passages associated with chamfered poppet valve 172 are in the form of external porting 176 which enables flow of pilot actuating fluid to corresponding exhaust passages 89. The external porting 176 is routed along the exterior of the chamfered poppet valve 172. As with other embodiments described herein, the shuttle 100/chamfered poppet valve 172 may be shifted so as to block or allow flow from actuating fluid passages 84 to flow line 60.

Embodiments described herein may utilize pilot valve(s) 78 to reduce power requirements for controlling the corresponding piloted main valve(s) 76. The pilot valve(s) 78 are operated to control a differential pressure across the internal shuttle/piston to automatically open and close a main flow of the actuating fluid, e.g. drilling mud, to the corresponding actuators 58, e.g. pads 62. The valve systems 74 described herein may be used with a variety of actuatable tools in which components/actuators are, for example, repeatedly and rapidly actuated. For example, the valve systems 74 may be used with various mud actuated tools, including rotary steerable systems, mud motors, reamers, jars, flow valves, flow control subs, and other types of actuatable tools utilized in downhole operations or other operations.

Depending on the parameters of a given application, the tool 56, e.g. steering tool 54, may utilize a variety of structures and actuators 58. The valve system 74 also may be constructed in various configurations with several types of components. In some embodiments, a flow passage may be routed through the shuttle with an appropriate choke selected to create desired differential pressures which force the shuttle between operational positions depending on whether the corresponding pilot valve is on or off. In some embodiments, the shuttle may include sides (sides 102, 104) having different diameters with a main fluid supply pressure provided between the different sides. In some embodiments, this arrangement may be structured to create an additional force on the shuttle that is constant and in a desired direction.

In some embodiments, the flow passages, e.g. the flow passage through the shuttle, may be used to provide continuous or regular flushing so that particles do not accumulate. In some embodiments, a back pressure in the pilot line may be used to limit a maximum differential pressure experienced by the pilot valve. Various embodiments described herein may be configured so each piloted main valve is nominally open or closed when the pilot valve is off. Additionally, various types, sizes, and configurations of the piloted main valves and the pilot valves may be selected according to the parameters of a given application.

By way of further examples, the shuttle 100 may be constructed with various cutouts, stops, chamfers, or other features, e.g., to provide desired damping as the shuttle 100 is shifted. At least portions of the shuttle 100, as well as surrounding sleeves or regions, may be formed of diamond-based materials or other hard materials, e.g., polycrystalline diamond or carbide materials, to reduce wear and to promote longevity in harsh downhole environments. Portions of the hard material, e.g. carbide, may be brazed or otherwise joined with the shuttle or other components of the valve system 74. In some embodiments, portions of the shuttle 100 may be formed as shear cutters or conical or bullet shaped cutters, e.g. polycrystalline diamond cutting elements. Additionally, the diameter and length of the various flow passages through or along the shuttle 100 may be adjusted to provide a desired timing with respect to shifting of the shuttle.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A system for use in a borehole, comprising:

a tool having one or more selectively actuatable components; and a valve system controlling selective actuation of the one or more selectively actuatable components, the valve system including:

a pilot valve; and a main valve shiftable between an open flow position and a restricted flow position in response to changes in fluid flow from the pilot valve, the main valve including:

a body defining a shuttle passage;

a fluid inlet arranged to receive fluid flow from the pilot valve; and a springless shuttle within the shuttle passage and movable therein, the springless shuttle having opposing first and second sides with a shuttle flow passage extending therebetween, a first surface area of the first side arranged to be acted on by fluid entering the shuttle flow passage and a second surface area of the second side arranged to be acted on by fluid exiting the shuttle flow passage, the first surface area being greater than the second surface area.

2. The system of claim 1, further comprising:

a choke within the shuttle flow passage.

3. The system of claim 1, the springless shuttle being a poppet.

4. The system of claim 1, the springless shuttle being a shear valve.

5. The system of claim 1, further comprising a plug, wherein the plug and the body create stops limiting movement of the springless shuttle.

6. The system of claim 1, the springless shuttle being movable in response to pressure differentials established on the first and second surface areas.

7. The system of claim 1, the shuttle flow passage arranged to control a fluid flow rate through the springless shuttle and build-up of pressure against the first surface area.

8. The system of claim 1, the shuttle flow passage arranged for continued fluid flow through the springless shuttle.

9. The system of claim 1, wherein the selectively actuatable components include one or more steering pads.

10. The system of claim 1, the valve system further comprising a pressure maintenance choke positioned to limit the maximum differential pressure the pilot valve will experience.

11. The system of claim 1, further comprising:

a flow line offset from the fluid inlet and which delivers fluid into contact with an outer surface of the springless shuttle, at a position between the opposing first and second sides.

12. The system of claim 11, further comprising:

an exhaust line in fluid communication with the shuttle flow passage.

13. The system of claim 12, further comprising a fluid outlet offset from the exhaust line and in communication with the flow line.

14. The system of claim 1, wherein the body is arranged to allow the fluid flow to contact an interior surface of the springless shuttle and to contact an exterior surface of the springless shuttle.

15. A system for use in a borehole, comprising:

a tool having one or more selectively actuatable components; and a valve system controlling selective actuation of the one or more selectively actuatable components, the valve system including:

a pilot valve; and a main valve shiftable between an open flow position and a restricted flow position in response to changes in fluid flow from the pilot valve, the main valve including:

a body defining a shuttle passage;

a fluid inlet arranged to receive fluid flow from the pilot valve; and a springless shuttle within the shuttle passage and movable therein, the springless shuttle having opposing first and second sides with a shuttle flow passage extending therebetween, a first surface area of the first side arranged to be acted on by fluid entering the shuttle flow passage and a second surface area of the second side arranged to be acted on by fluid exiting the shuttle flow passage, the first surface area being different than the second surface area, and the shuttle flow passage arranged to control a fluid flow rate through the springless shuttle and build-up of pressure against the first surface area.

16. The system of claim 15, further comprising a plug, wherein the plug and the body create stops limiting movement of the springless shuttle.

17. The system of claim 15, the springless shuttle being movable in response to differentials established on the first and second surface areas.

18. A system for use in a borehole, comprising:

a tool having one or more selectively actuatable components;

a valve system controlling selective actuation of the one or more selectively actuatable components, the valve system including:

a pilot valve; and a main valve shiftable between an open flow position and a restricted flow position in response to changes in fluid flow from the pilot valve, the main valve including:

a body defining a shuttle passage;

a fluid inlet arranged to receive fluid flow from the pilot valve;

a springless shuttle within the shuttle passage and movable therein, the springless shuttle having opposing first and second sides with a shuttle flow passage extending therebetween, a first surface area of the first side arranged to be acted on by fluid entering the shuttle flow passage and a second surface area of the second side arranged to be acted on by fluid exiting the shuttle flow passage, the first surface area being different than the second surface area; and a flow line offset from the fluid inlet and which delivers fluid into contact with an outer surface of the springless shuttle, at a position between the opposing first and second sides.

19. The system of claim 18, further comprising an exhaust line in fluid communication with the shuttle flow passage.

20. The system of claim 19, further comprising a fluid outlet offset from the exhaust line and in communication with the flow line.

* * * * *